US006991127B2

(12) United States Patent
Huang

(10) Patent No.: US 6,991,127 B2
(45) Date of Patent: Jan. 31, 2006

(54) COLLAPSIBLE REFUSE CAN

(76) Inventor: Hsiang-Hua Chiu Huang, P.O. Box 6-9, Tainan 717 (TW)

( * ) Notice: Subject to any disclaimer, the term of this patent is extended or adjusted under 35 U.S.C. 154(b) by 287 days.

(21) Appl. No.: 10/698,355

(22) Filed: Oct. 20, 2003

(65) Prior Publication Data

US 2005/0082285 A1 Apr. 21, 2005

(51) Int. Cl.
*B65D 43/26* (2006.01)

(52) U.S. Cl. ..... 220/263; 220/908; 220/908.1; 220/4.28

(58) Field of Classification Search ..... None
See application file for complete search history.

(56) References Cited

U.S. PATENT DOCUMENTS 1,922,729 A * 8/1933 Geibel ..... 220/23.89
2,549,572 A * 4/1951 Campanelli ..... 220/212
5,230,525 A * 7/1993 Delmerico et al. .... 280/47.131
5,671,861 A * 9/1997 Hall et al. ..... 220/495.08
6,311,859 B1 * 11/2001 Haas ..... 220/4.22
2004/0164077 A1 * 8/2004 Kuo ..... 220/263

* cited by examiner

*Primary Examiner*—Stephen Castellano

(57) ABSTRACT

A collapsible refuse can includes a can body, a bottom, a cap, a pedal and a cap opening member and plural bag hangers. The can body consists of two half shells combined by means of elongate hooks, with the bottom fitted firmly in a lower open side with an open upper side closed with a cap possible to be opened by the cap opening member, when the cap opening member is lifted up by the pedal stepped down. And a refuse bag is secured on an upper inner surface of the can body by means of the plural bag hangers. Then the collapsible refuse can has a small size when collapsed, beneficial for carrying, transporting and storing.

2 Claims, 5 Drawing Sheets

COLLAPSIBLE REFUSE CAN

BACKGROUND OF THE INVENTION

1. Field of the Invention

This invention relates to a collapsible refuse can, particularly to one collapsible for convenience of transporting, storing, and displaying and quick to assemble together, 2. Description of the Prior Arts Refuse cans are indispensable for our daily life, and there are many kinds of refuse cans in use and on the market for different uses, generally consisting of a can body and a liftable cap.

However, almost conventional refuse cans are made integral to have a certain size impossible to be collapsed to a small size, quite unfavorable for storing, carrying, transporting, etc.

SUMMARY OF THE INVENTION

This invention has been devised to offer a collapsible refuse can to improve conventional refuse cans impossible to be collapsed.

The feature of the invention is a can body consisting of two half shells, and a bottom closely combined with the can body, and a pedal moving a cap opening member for opening a cap.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
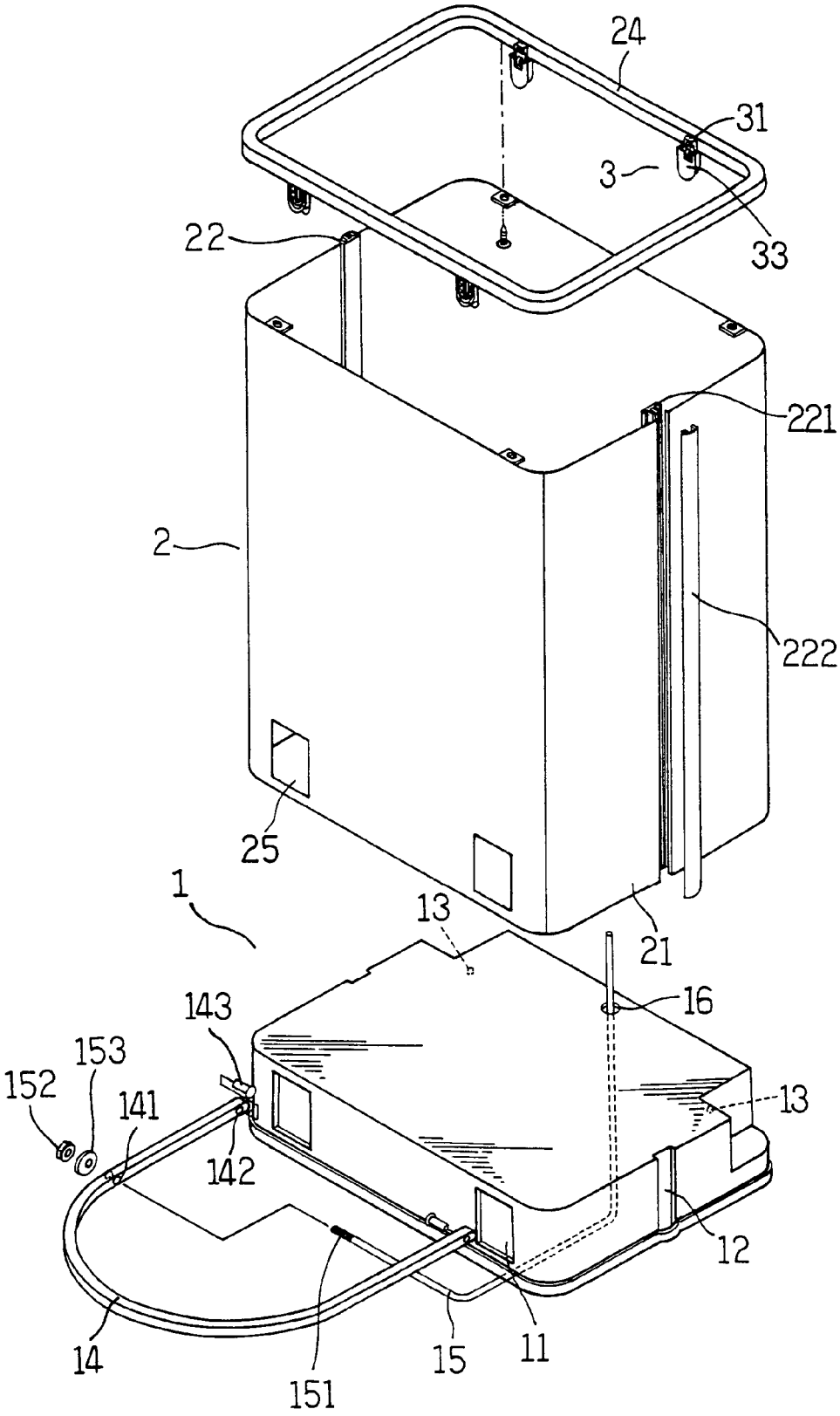
FIG. 1 is an exploded perspective view of a collapsible refuse can in the present invention.
Figure 2:
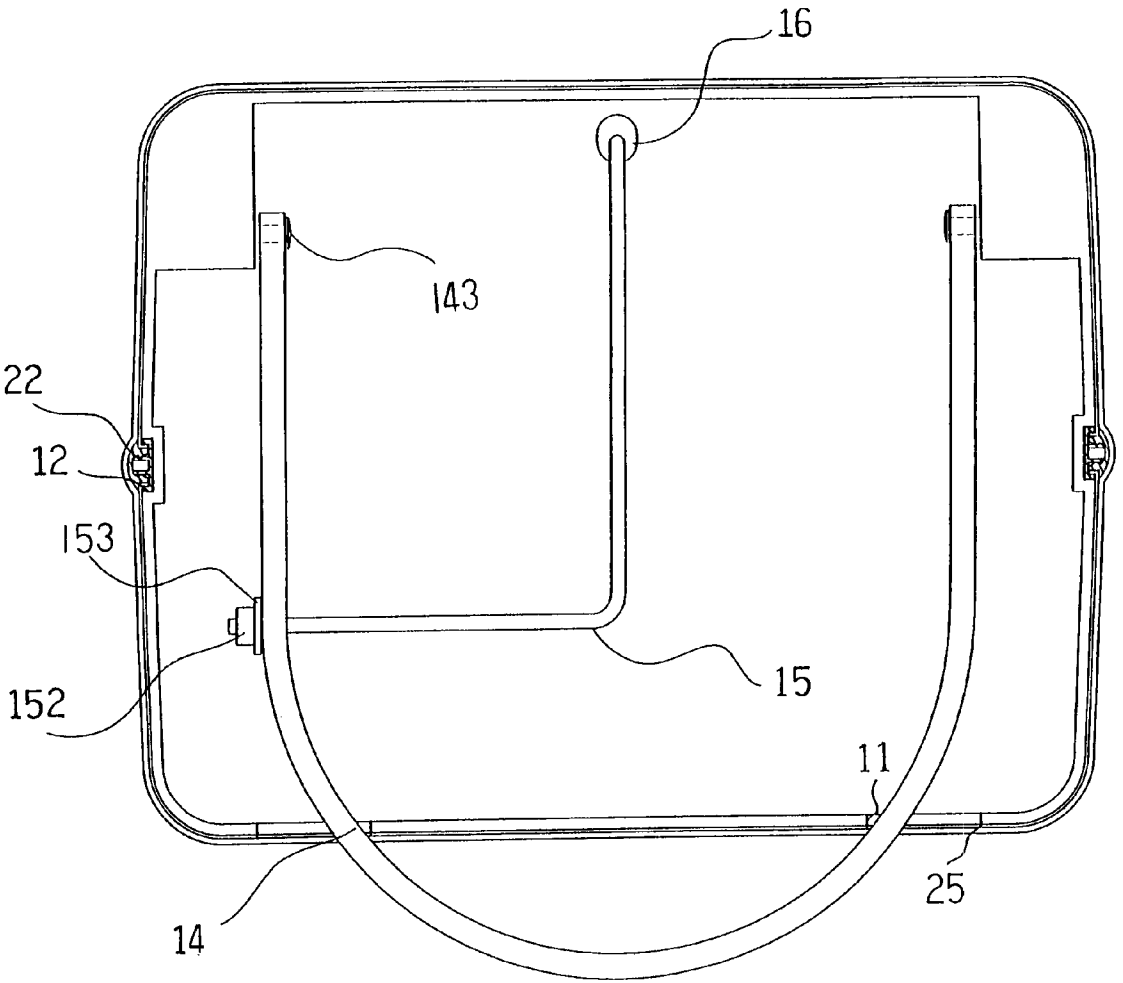
FIG. 2 is a bottom view of the collapsible refuse can in the present invention.
Figure 3:
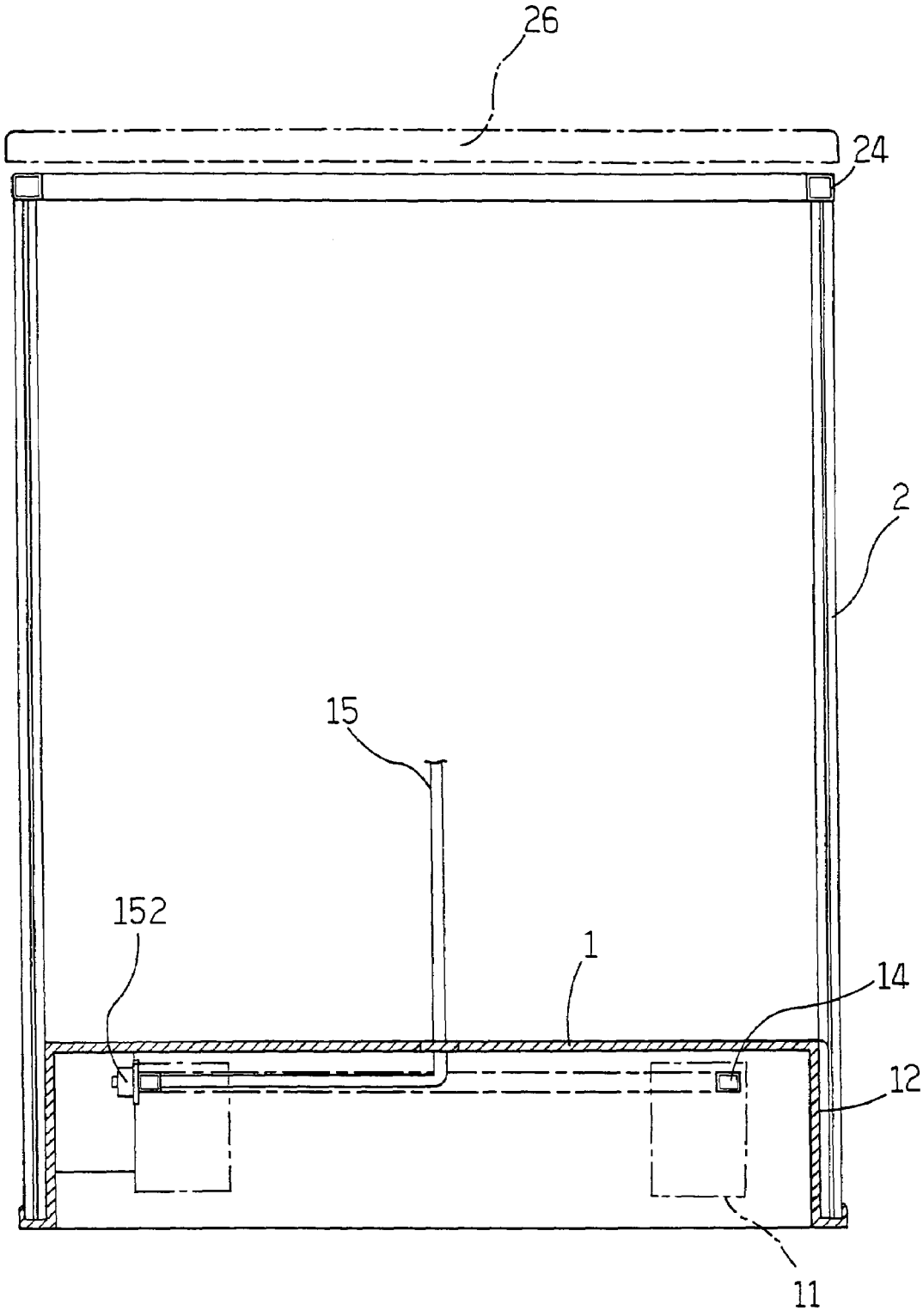
FIG. 3 is a rear view of the collapsible refuse can in the present invention.

A preferred embodiment of a collapsible refuse can in the present invention, as shown in FIGS. 1–6, includes a can body 2 consisting of two half shells 21, a bottom 1, a pedal 14, and a cap opening member 15, a fix frame 24 and a cap 26 and plural bag hangers 3 as main components.

The two half shells 21 are shaped as U and combined together to form the can body 2 with an open upper and an open lower side, having an inner vertical hook strip 221 formed respectively at two vertical end edges for an elongate hooking strip 222 to respectively hook with the two inner vertical hooking strips 221 to combine the two half shells 21 together to form the can body 2, which has two holes 25 spaced apart in a lower portion of a front side.

The bottom 1 is made integral, fitting in a lower portion of the can body 2, having two square holes 11 spaced apart properly in a front side for two ends of the pedal 14 to pass through, and a through hole 16 provided vertically in a rear center portion for the cap opening member 15 to pass up through, a vertical groove 12 respectively formed in two opposite sides for the elongate hook strip 22 to hook therein, a hole 13 respectively in two opposite sides aligned to the holes 142 in two ends of the pedal 14 for rivets to combine the pedal 14 with the bottom 1.

The pedal 14 is made of an elongate curved rod, having two ends passing through the two holes 25 of the can body 2 and the two holes 11 of the bottom 1 and then combined with the bottom 1 with the rivets 143 fitting in the holes 142 and 13.

The cap-opening member 15 a double L-shaped elongate rod having a lower end provided with male threads 151 to pass through a hole 141 of the pedal 14 and then screwed with a nut 152 and a washer 153 tightly. Then the upper end of the cap-opening member 15 passes upward through the hole 16 of the bottom 1, and then pivotally connected with the cap 26.

The bag hangers 3 respectively have a position member 31 with a curved portion 32 and a lower saw-toothed pinching portion 34, and a bendable member 33 with a groove portion 35 and a sidewise shaft. The positioned member 31 is fixed firmly on an inner periphery of the fix frame 24. The sidewise shaft of the bendable member 33 is formed at a rear end to be kept rotatably in the curved portion 32 to permit the bendable member 33 pushed to swing down with the sidewise shaft as a pivot to fit on the lower saw-toothed pinching portion 34 of the fixing member 31 so that an upper end of a refuse bag may be sandwiched between the lower pinching portion 34 and the groove portion 35 of the bendable member 33 to be hung in the refuse can.

In assembling, firstly, the two half shells 21 are combined together by hooking the two hooking strips 222 with the inner hooking strips 221, with the lower end of the hooking strips 222 fitting in the grooves 12 of the bottom 1 when the bottom 1 is fitted in the lower portion of the can body 2. After the can body 2 and the bottom 1 are combined together, the holes 25 of the can body 2 are aligned with the two holes 11 of the bottom 1, and then the pedal 14 is pushed in the bottom 1, with the two ends of the pedal 14 respectively passing through the two sets of the holes 11 and 25. Then the two holes 142 of the pedal 14 and the holes 13 of the bottom 1 are aligned for the rivets 143 to fit in the holes 142 and 13 to secure the pedal 14 with the bottom 1. Next, the cap opening member 15 is combined firmly with the pedal 14, by the nut 152 with the washer 153 screwed stably with the lower end with the male threads 151 of the cap opening member.

Figure 5:
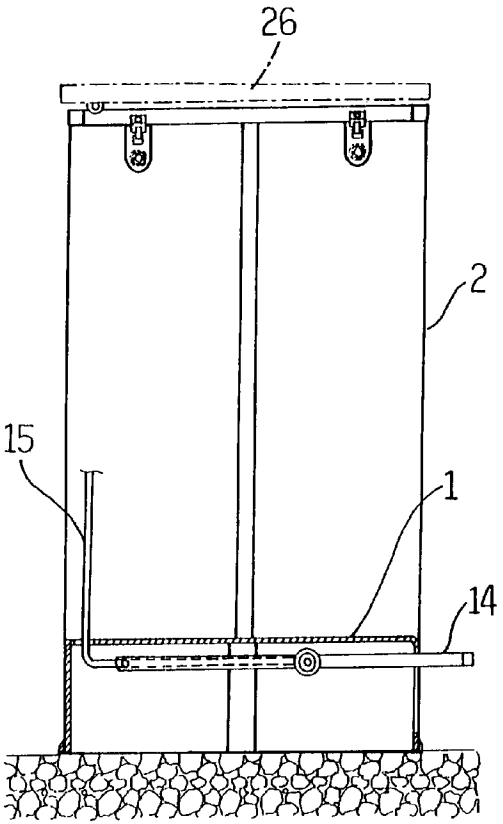
FIG. 5 is a second cross-sectional view of the collapsible refuse can in the present invention; and, FIG. 6 is a cross-sectional view of a fixing member in the present invention.
Figure 4:
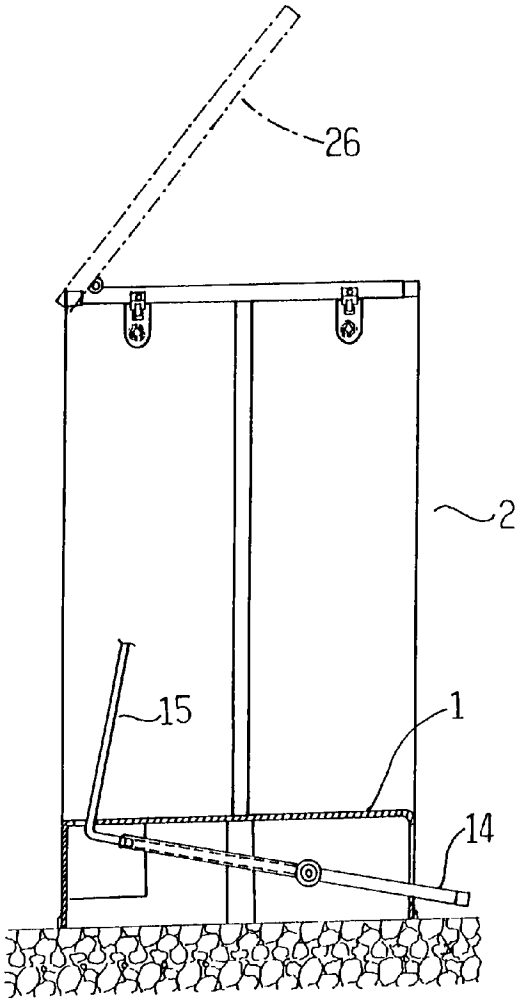
FIG. 4 is a first cross-sectional view of the collapsible refuse can in the present invention.
Figure 6:
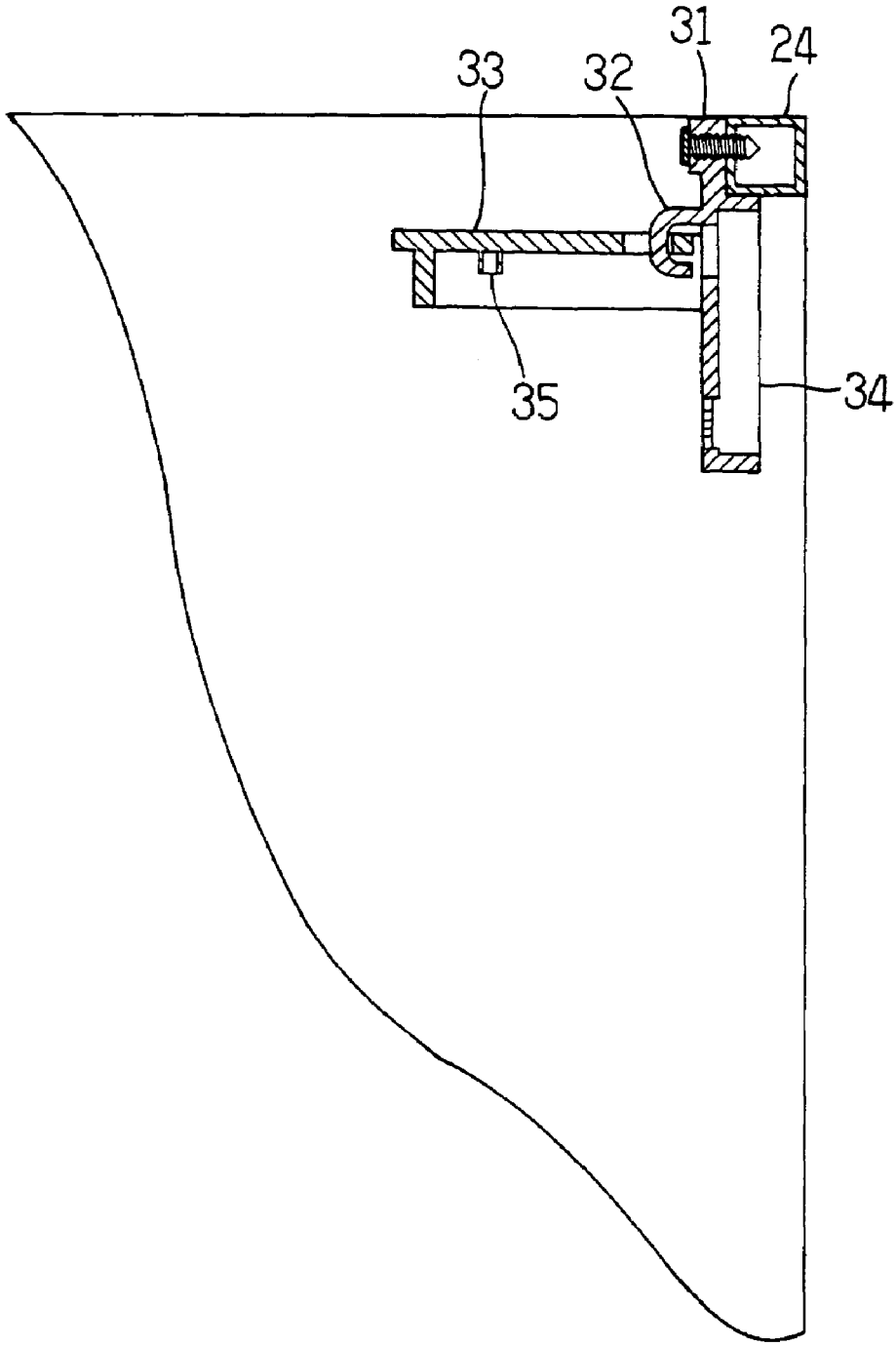

In using, as shown in FIGS. 4 and 5, when the pedal 14 is stepped down, the cap opening member 15 is moved by the pedal 14 to have its upper end push up the cap 26, and refuse can be thrown in a refuse bag hung in the can body 2. To close the cap 26, releasing the foot stepping down the pedal 14 can attain the objective, as the cap 26 has a weight to fall down to close up the can body 2.

While the preferred embodiment of the invention has been described above, it will be recognized and understood that various modifications may be made therein in and the appended claims are intended to cover all such modifications that may be covered by the spirit and scope of the invention.

What is claimed is:

1. A collapsible refuse can comprising:

A can body consisting of two half shells, each said half shelf having a U-shape and two vertical end edges formed respectively with an inner hook strip for an outer elongate hook strips to hook with for combine said two half shelf to form said can body:

A bottom fitting in a lower portion of said can body, made integral, having a vertical groove respectively formed in two opposite sides for said two outer elongate hooks to fit therein to combine said bottom with said can body:

A pedal made of an elongate rod bent to shape as a pedal, having two ends respectively formed with a hole to align with the holes of the two opposite sides of said bottom for a rivet to fit in for combining said pedal with said bottom after the two ends of said pedal are inserted through the two holes of said can body and said bottom, said pedal further having a sidewise hole in a left side portion:

A cap opening member made of an elongate rod bent into double L-shape, having a lower male-threaded end to pass through said sidewise hole of said pedal and screwing tightly with a nut with a washer and an upper end passing through the vertical hole of said bottom and pivotally connected with said cap: and, Said pedal stepped down at the front portion to let its two ends to lift up said cap opening member to push open said cap for refuse to be thrown into a refuse bag placed in said can body.

2. A collapsible refuse can as claimed in claim 1, wherein further a plurality of bag hangers fixed spaced apart on an inner circumferential surface of said fix frame fixed around an inner periphery of said can body, each said bag hangers consisting of a position member and a bendable member, said position member fixed on the inner circumferential surface of said fix frame and having a curved portion to extend forward from an intermediate section and a saw-toothed pinching portion formed in a lower portion, said bendable member positioned to vertical to said position member and having a sidewise shaft formed at its rear end and fitted rotatably in the curved portion of said position member, said bendable member pushed to swing down with the shaft as a pivot to fit on the pinching portion to let one point of an upper end of a refuse bag sandwiched between the lower saw-toothed pinching portion and the groove portion so that the refuse bag may be hung in the refuse can.

* * * * *